US008847843B2

(12) United States Patent
Miwa et al.

(10) Patent No.: US 8,847,843 B2
(45) Date of Patent: Sep. 30, 2014

(54) ELECTRONIC EQUIPMENT AND ARRANGEMENT STRUCTURE FOR ANTENNA SUBSTRATE

(75) Inventors: Yasuhiro Miwa, Sagamihara (JP); Tomohiro Manabe, Hachiouji (JP)

(73) Assignee: JVC Kenwood Corporation, Yokohama-shi, Kanagawa (JP)

( * ) Notice: Subject to any disclaimer, the term of this patent is extended or adjusted under 35 U.S.C. 154(b) by 210 days.

(21) Appl. No.: 13/634,109

(22) PCT Filed: Mar. 10, 2011

(86) PCT No.: PCT/JP2011/055660
§ 371 (c)(1),
(2), (4) Date: Sep. 11, 2012

(87) PCT Pub. No.: WO2011/111782
PCT Pub. Date: Sep. 15, 2011

(65) Prior Publication Data

US 2013/0002508 A1 Jan. 3, 2013

(30) Foreign Application Priority Data

Mar. 12, 2010 (JP) ..... 2010-056607
Dec. 28, 2010 (JP) ..... 2010-293253
Feb. 22, 2011 (JP) ..... 2011-035613

(51) Int. Cl.
*H01Q 1/52* (2006.01)
*H01Q 1/00* (2006.01)

(52) U.S. Cl.
CPC ..... *H01Q 1/007* (2013.01)
USPC ..... 343/841; 343/702; 343/872

(58) Field of Classification Search
CPC ..... H01Q 1/243; H01Q 1/3291; H01Q 1/325
USPC ..... 343/841, 702, 872
See application file for complete search history.

(56) References Cited

FOREIGN PATENT DOCUMENTS

| | | | |
|---|---|---|---|
| JP | 2002-32150 | A | 1/2002 |
| JP | 2003-244010 | A | 8/2003 |
| JP | 2003-273622 | A | 9/2003 |
| JP | 2004-282567 | A | 10/2004 |
| JP | 2005-075301 | A | 3/2005 |
| JP | 3762317 | A | 1/2006 |
| JP | 2006-173734 | A | 6/2006 |
| JP | 2008-040904 | A | 2/2008 |

*Primary Examiner* — Dameon E Levi
*Assistant Examiner* — Collin Dawkins
(74) *Attorney, Agent, or Firm* — Nath, Goldberg & Meyer; Jerald L. Meyer; Stanley N. Protigal

(57) ABSTRACT

An electronic equipment comprises: a metal casing defining a first face formed so as to provide an opening, a second face connected to the first face; and a shielding member arranged adjacent to the first face to shield radio waves, wherein the metal casing has a cutout formed in the second face so as to come close to the first face, a part of the shielding member is arranged to be closer to the first face than a first end of the cutout, the first end is further away from the first face than a second end of the cutout on the side of the first face, and wherein an antenna is provided on outer side of a virtual line connecting a corner of the shielding member adjacent to the first face and closest to the second face with the first end of the cut out.

6 Claims, 10 Drawing Sheets

ELECTRONIC EQUIPMENT AND ARRANGEMENT STRUCTURE FOR ANTENNA SUBSTRATE

This is a National Phase Application filed under 35 U.S.C. 371 as a national stage of PCT/JP2011/055660, filed Mar. 10, 2011, an application claiming benefit from the Japanese Application No. (s). 2010-056607, filed 12 Mar. 2010, and Application No. 2010-293253, filed 28 Dec. 2010, and from Application No. 2011-035613, filed 22 Feb. 2011, the content of each of which is hereby incorporated by reference in its entirety.

TECHNICAL FIELD

The present invention relates to an electronic equipment and an arrangement structure for an antenna substrate.

BACKGROUND ARTS

Delivery of contents from a server to terminals and transmitting of contents selecting information from terminals to a server are becoming possible through the intermediary of networks. Contents to be delivered comprise pictures, music, broadcast program containing such pictures and music and so on. For a terminal to be connected to a network, it is considered to allow a home-use audio and video equipment (referred to as "AV equipment" later) to have a function of wireless communication function. Concretely, a radio transceiver (referred to as "radio unit" later) compatible with a designated wireless communication system, such as Blue tooth (trade mark) and wireless LAN, is built in or externally added to an AV equipment. The AV equipment is connected to a network by such a built-in or externally-added "radio unit".

Patent Document No. 1 discloses an electronic equipment capable of radio communication, which includes its antenna arrangement structure having a print-wiring board jutting into an area outside a hard-disc drive unit and a built-in antenna positioned at one end of the print-wiring board in a chassis end, the built-in antenna being also located at an intermediate part of the chassis in the direction of thickness. Patent Document No. 2 discloses an information processing device as the electronic equipment, which includes a structure where the back face of a display unit is covered with a metal chassis, and an antenna is arranged in a notch part formed in a part of the metal casing. Patent Document No. 3 discloses an information processing device as the electronic equipment, which includes a structure where an antenna is positioned near the inside of a slot opening for memory card.

PRIOR ART DOCUMENTS

Patent Documents

Patent Document 1: Japanese Patent No. 3762317

Patent Document 2: Japanese Unexamined Patent Publication Laid-open No. 2002-32150

Patent Document 3: Japanese Unexamined Patent Publication Laid-open No. 2005-75301

SUMMARY OF THE INVENTION

Problems to be Solved

Meanwhile, if an electronic equipment having a radio unit is portable, its transmission and reception situation of radio waves, such as receiving intensity, could be improved with relative ease by changing the posture of the electronic equipment. In other word, there is less possibility that the radio transmitting and receiving situation is affected by the built-in position of an antenna significantly. However, if an electronic equipment having a radio function is a stationary AV equipment to be arranged in position inside a room, then it is difficult to change the posture of the AV equipment to improve the transmission and reception situation of radio waves. Therefore, it is necessary to determine the arrangement form of an antenna in the radio equipment so that the equipment can transmit and receive radio waves irrespective of its installations, appropriately as possible.

Under such a background mentioned above, an object of the present invention is to provide an electronic equipment and an arrangement structure for an antenna substrate, both of which can transmit and receive radio appropriately.

Solutions to the Problems

In order to solve the above problem, an electronic equipment in accordance with an embodiment of the present invention comprises the following constitutions (1) to (8).

(1) In an electronic equipment comprising: an antenna 6, 66 used to transmit or receive radio waves; a metal casing 2 having a first face formed to provide an opening; and a shielding member 4, 15 arranged close to the first face to shield the radio waves, the metal casing 2 has a second face connected to the first face, the second face having a cutout 5 formed on a metal casing end on the side of the first face, the shielding member is arranged so that at least a part thereof is on the side of the first face to a back end 7 of the cutout; and in a plan view of a third face connected to the first face and the second face, the antenna 6,66 is positioned outside a virtual line segment L which connects a corner part 4*mt*, 15*mt* of the shielding member on the side of the second face with the back end, the corner part being positioned in a shielding member's end face 4*zt*, 15 on the side of the first face, which is the farthest from the back end of the cutout.

(2) In the electronic equipment of (1), the shielding member is a metal door 15 opposed to the first face.

(3) In the electronic equipment of (1), the shielding member is an electronic block accommodated in the metal casing and covered with an metallic exterior package 4*k*.

(4) In the electronic equipment of (1), it further comprises: a metal door 15 opposed to the first face; and an electronic block accommodated in the metal casing 2 and covered with an metallic exterior package 4*k*, wherein in the plan view of the third face connected to the first face and the second face, the antenna is positioned outside a virtual line segment which connects a corner part with the back end, the corner part being either one of: a block corner part of an electronic-block's end face on the side of the first face, the block corner part being positioned on the side of the second face; and a door corner part of the metal door on the side of the second face, the corner part being one closer to the second face than the other.

(5) In the electronic equipment of any one of (1) to (4), the antenna is in the form of a wiring pattern 6*a*, 66*a* printed on a substrate 6, 66, and the substrate is attached to the metal casing so that the wiring pattern is exposed into the cutout.

(6) In the electronic equipment of (5), assuming that a wavelength of center frequency of radio waves transmitted or received by the antenna is represented by $\lambda$, the wiring pattern comprises: parallel lines each having a length of $\lambda/4$ in the direction of depth and being apart from each other at an interval of $\lambda/6$; an end line connecting respective back ends of the parallel lines in the direction of depth with each other; and a power supply line supplying the parallel lines with electric power.

(7) In the electronic equipment of any one of (1) to (6), the antenna is arranged in each of the second face of the metal casing and a fourth face opposed to the second face.

(8) In the electronic equipment of any one of (3) to (7), the electronic block is a disc drive unit 4 having an insert slot for disc-shaped record media, and the insert slot is arranged so as to extend in a direction along a long side of the opening.

In order to solve the above problem, additionally, an arrangement structure for an antenna substrate in accordance with an embodiment of the present invention comprises the following constitution (9).

(9) In an arrangement structure of an antenna substrate in an electronic equipment having a metal casing and a shielding member of radio waves, the metal casing is formed with a first face providing an opening, the metal casing has a second face connected to the first face, the second face having a cutout 5 formed on a metal casing end on the side of the first face, the shielding member is arranged so that at least a part thereof is closer to the first face than a back end 7 of the cutout, and in a plan view of a third face connected to the first face and the second face, the antenna is positioned outside a virtual line segment which connects a corner part 4*mt*, 15*mt* of the shielding member on the side of the second face with the back end, the corner part being positioned in a shielding member's end face 4*zt*, 15 which is the farthest, on the side of the first face, from the back end of the cutout.

Effects of the Invention

According to the present invention, it is possible to provide an electronic equipment and an arrangement structure for an antenna substrate, both of which can transmit and receive radio waves appropriately.

EMBODIMENTS OF THE INVENTION

Referring to drawings, an embodiment of the present invention will be described below.

[Overall Constitution]

Figure 1:
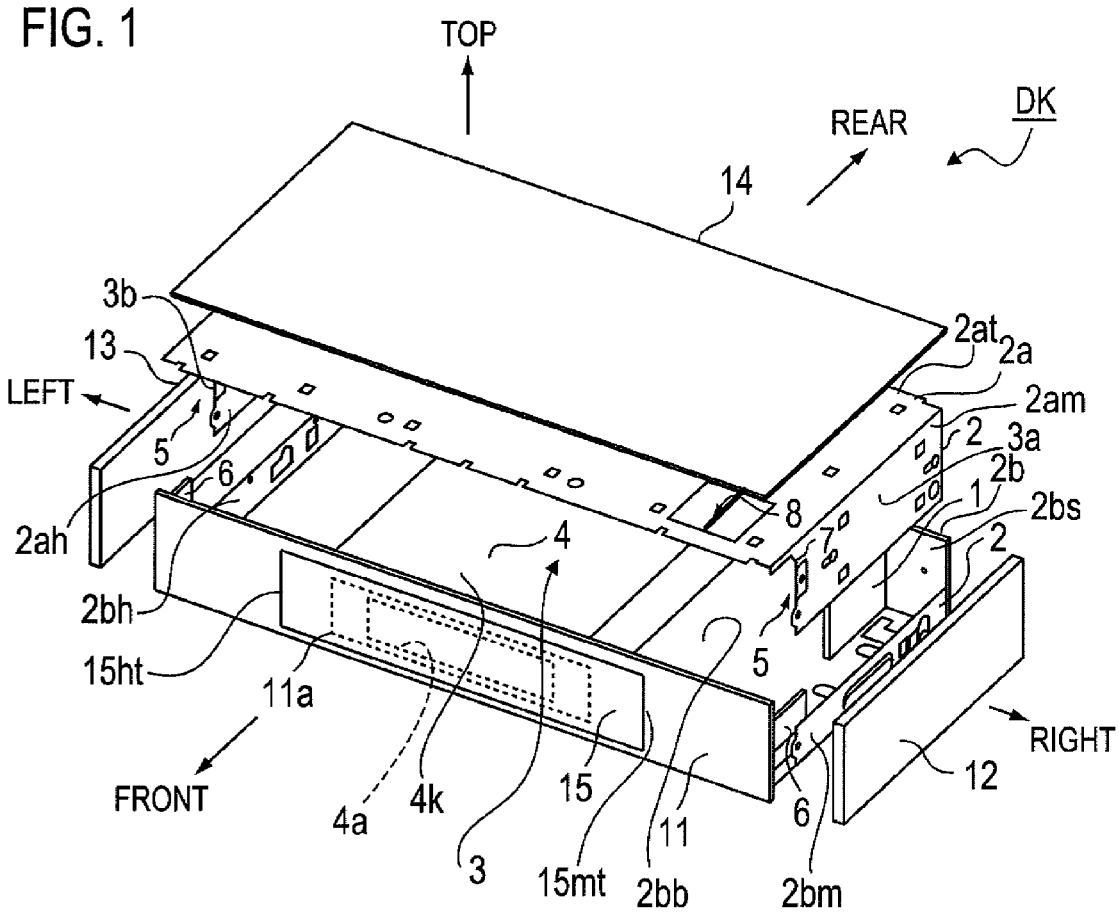
FIG. 1 is an exploded perspective view showing the structure of an electronic equipment of an embodiment of the present invention.
Figure 2:
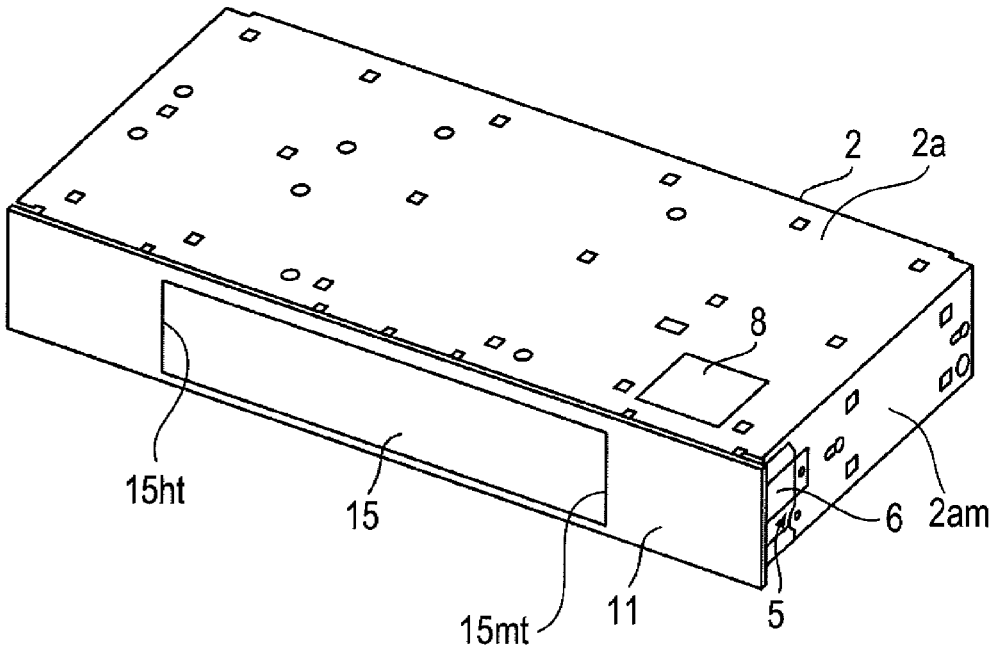
FIG. 2 is a perspective view showing a condition that a metal casing is closed in the electronic equipment of FIG. 1.
Figure 3:
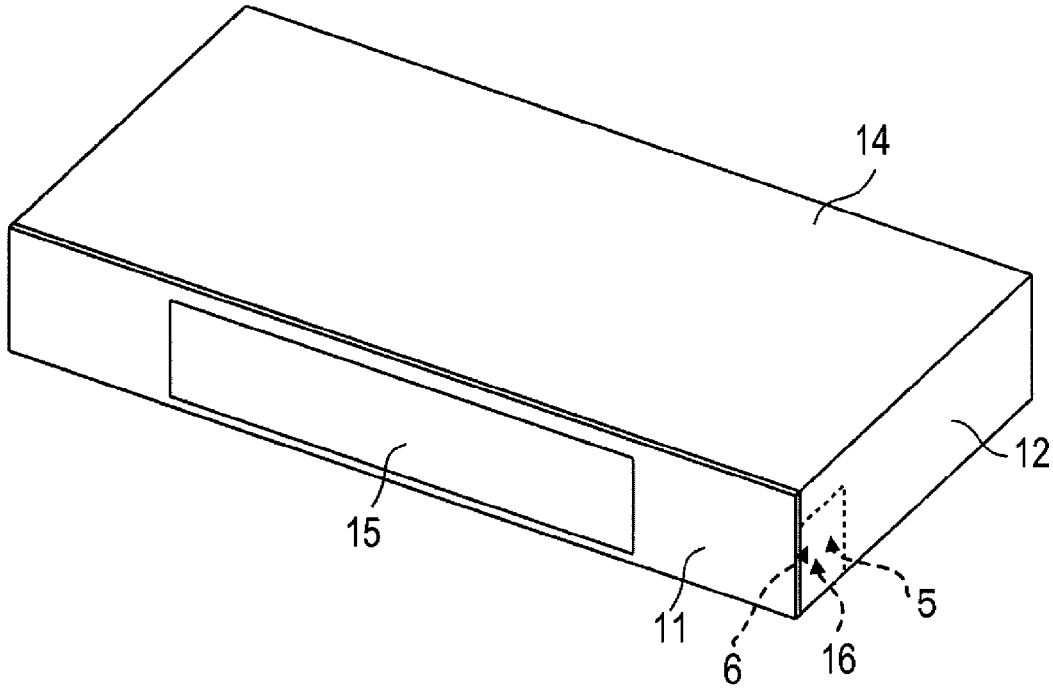
FIG. 3 is a perspective view of the appearance of a completed condition where the electronic equipment of FIG. 1 is assembled.

The embodiment of an electronic equipment of the present invention will be described with reference to FIGS. 1 to 3. This embodiment is related to an electronic equipment DK including a disc driving unit. FIG. 1 is an exploded perspective view of the electronic equipment DK. FIG. 2 is a perspective view showing an assembled casing 2 of the electronic equipment DK of FIG. 1. Decorative side plates 12, 13 and a top plate 14 of FIG. 1 are detached in FIG. 2. FIG. 3 is a perspective view of the appearance of the electronic equipment DK where the equipment of FIG. 1 is assembled by attaching the decorative side plates 12, 13 and the top plate 14.

The electronic equipment DK includes a radio unit 1 having a circuit for radio communication executing at least either one of transmission and reception of radio waves. The wireless communication system for use in the equipment is formed by wireless LAN (IEEE802.11b/g/n) as an example.

The electronic equipment DK, which is in the form of a flat hexahedron thinned in the top-to-bottom direction in the installed condition, includes a casing 2 for chassis consisting of an upper casing 2*a* and a lower casing 2*b* both obtained by dividing the chassis into two pieces in the top-to-bottom direction generally. The upper casing 2*a* is made from metallic material and includes a top plate 2*at*, a right side plate 2*am* and a left side plate 2*ah*, which are adapted to have a substantial-U shaped cross section along the right-to-left direction.

The lower casing 2*b* includes a bottom plate 2*bb*, a right flange 2*bm* standing from a right edge of the bottom plate 2*bb* upwardly, a left flange 2*bh* standing from a left edge of the bottom plate 2*bb* upwardly and a back plate 2*bs* standing from a rear edge of the bottom plate 2*bb* upwardly and is made from metallic material.

The electronic equipment DK is opened on the front side under condition that the upper casing 2*a* is incorporated with the lower casing 2*b*. That is, the casing 2 is provided, on the front side, with an opening 3 defined by respective front edges of the upper casing 2*a* and the lower casing 2*b*. The radio unit 1 is accommodated in the casing 2.

Figure 4:
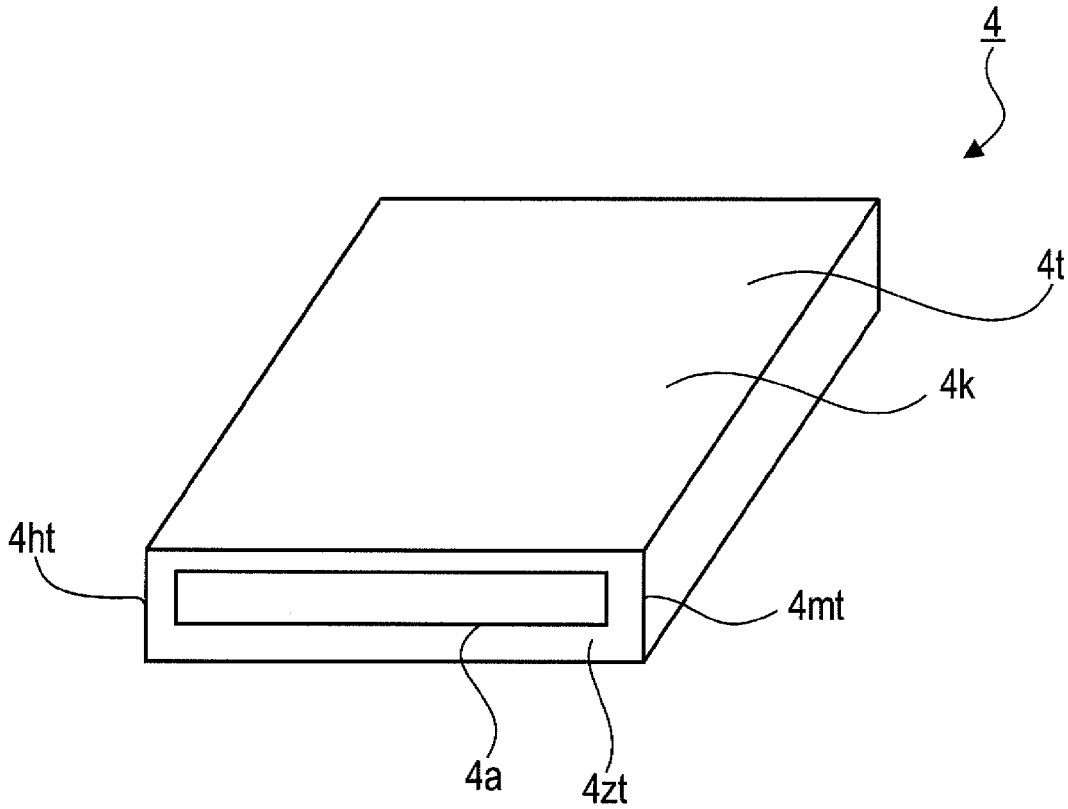
FIG. 4 is a view showing the appearance of a disc drive unit.

In the electronic equipment DK, a disc drive unit 4 is accommodated in the casing 2 and includes a metal chassis as a separate block from the casing 2. FIG. 4 is an appearance perspective view of the disc drive unit 4. The disc drive unit 4 includes a metal chassis 4*k* and an insert slot 4*a* arranged on a front face of the chassis. The disc drive unit 4 is accommodated in the casing 2 and also positioned in the vicinity of the front side of the casing 2, in a generally-intermediate position in the right-to-left direction. In the chassis 4*k* of the disc drive unit 4, a front end face 4*zt* is located in a position in contact with or adjacent to the front panel 11.

The disc drive unit 4 drives a disc-shaped recording medium, such as Blu-ray Disc (trademark) and DVD (simply referred to as "disc" later), and performs recording or reproduction of the disc. The disc drive unit 4 has the insert slot 4*a* at a position visible from the opening 3 of the casing 2 to insert a disc from the outside into a position and withdraw the disc therefrom. The insert slot 4*a* is arranged so that its longitudinal direction extends along the longitudinal direction (right-to-left direction) of the electronic equipment DK.

Note that the disc drive unit 4 is an example illustrative of electronic equipment blocks (also referred to as "electronic blocks") each having an exterior surface accommodated in the casing 2 and made from metallic material, and therefore the electronic block is not limited to only the disc drive unit. For the electronic block, for example, there is a hard-disc drive unit, tuner unit, shielded substrate unit or the like.

A front panel 11 is attached to respective front sides of the upper casing 2*a* and the lower casing 2*b*. The opening 3 is closed up with the front panel 11. The front panel 11 is made from resinous material as nonmetallic materials and also formed with an opening 11*a* which is positioned corresponding to the insert slot 4*a*, within an area containing the insert slot 4*a*.

The front panel 11 may be provided, at its central portion, with a generally-rectangular door 15 which is elongated in the right-to-left direction so as to close up the opening 11*a*. FIGS. 1 to 3 illustrate arrangements having the doors 15 respectively. By way of example, the arrangement equipped with the door 15 will be described below.

The door 15 is made from aluminum material. The door 15 is constructed so as to enable a reciprocating movement between a normal position illustrated with FIG. 2 (i.e. middle position of the front panel 11) and a disc insertion/withdrawal position where the lower end of the door 15 is positioned below the lower end of the front panel 11. When the door 15 occupies the normal position, the opening 11*a* is closed up with the door 15. When the door 15 occupies the disc insertion/withdrawal position, the opening 11*a* is exposed to the exterior, allowing a disc to be inserted into the disc drive unit 4 and also withdrawn therefrom. The movement of the door 15 between the normal position and the disc insertion/withdrawal position is controlled by a not-shown door driving mechanism or the like.

The door 15 is sized so that its left end 15*ht* and right end 15*mt* are positioned outside a left end 4*ht* of the disc drive unit 4 and its right end 4*mt* (see FIG. 4) in the right-to-left direction, respectively. For an arrangement without the door 15, instead, the panel may be provided with a door (not shown) made from nonmetallic material. Alternatively, the opening 11*a* may be exposed instead of such a door.

As shown in FIG. 1, the upper casing 2*a* is provided, in the right side plate 2*am*, with the cutout 5 which is cut-in from a casing side close to the front panel 11 to rearward of the casing. The cutout 5 is also formed in the left side plate 2*ah* as well. In the cutout 5, its end side 7 is located behind a front end face 4*zt* of the chassis 4*k* of the disc drive unit 4 in the direction of depth. The top plate 2*at* of the upper casing 2*a* is provided with a cutout 8 which is close to the opening 11*a* and the right side plate 2*am*.

The electronic equipment DK includes, as the antenna of the radio unit 1, antenna substrates 6 having antenna elements as wiring patterns, which are arranged on left and right sides of the chassis (casing 2) respectively. That is, the electronic equipment DK has a pair of antenna elements. In accordance with diver-city, the radio unit 1 may select a better one of the pair of antenna elements preferentially.

[Antenna Substrate]

Figure 5:
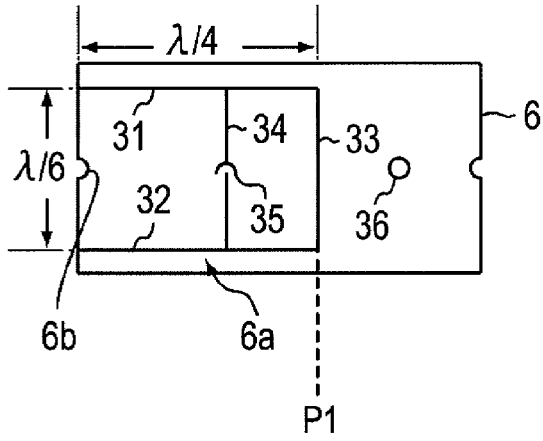
FIG. 5 is a view explaining an antenna substrate of FIG. 1 and an example of its wiring pattern.

Here, we describe the antenna substrate 6. FIG. 5 is a view explaining one example of the antenna substrate 6. In the illustrated example, the wiring pattern is formed by an antenna element so-called "fork hentenna".

A wiring pattern 6*a* is formed on the antenna substrate 6. The wiring pattern 6*a* comprises parallel lines 31, 32, an end line 33 connecting respective deeper ends of the parallel lines 31, 32 in the right-to-left direction of FIG. 5 with each other and a power supply line 34 supplying the parallel lines 31, 32 with electric power. The power supply line 34 has a connecting terminal 35 for connection with a coaxial cable.

Although the antenna element of the wiring pattern 6*a* does not have a strikingly-great directionality in a specific direction, it exhibits a greater directionality to the side of open ends of the parallel lines 31, 32 (left of FIG. 5).

The parallel lines 31, 32 have lengths in the direction of depth equal to a quarter ($\lambda/4$) of wavelength $\lambda$ of the center frequency (e.g. 2.4 GHz band) of radio waves that the radio unit 1 does transmit or receive. The interval of the parallel lines 31, 32 in the top-to-bottom direction (up-to-down direction of FIG. 5) is equal to $\lambda/6$.

Note that the horizontal lengths and vertical interval of the parallel lines 31, 32 are not limited to exact $\lambda/4$ and $\lambda/6$ respectively, each parameter contains a range of allowable errors. As for the horizontal lengths and vertical interval of the parallel lines 31, 32, the ranges of allowable errors about $\lambda/4$ and $\lambda/6$ could be introduced from actual measurements obtained by monitoring actual reception circumstance of radio waves.

The antenna substrate 6 is formed with a fixing hole 36. The antenna substrate 6 is attached to the casing 2 so that at least the wiring pattern 6*a* is located in an area outside a reference plane KM (i.e. case's side excluding a center 23 of the casing 2) containing a line segment L described below.

Figure 6:
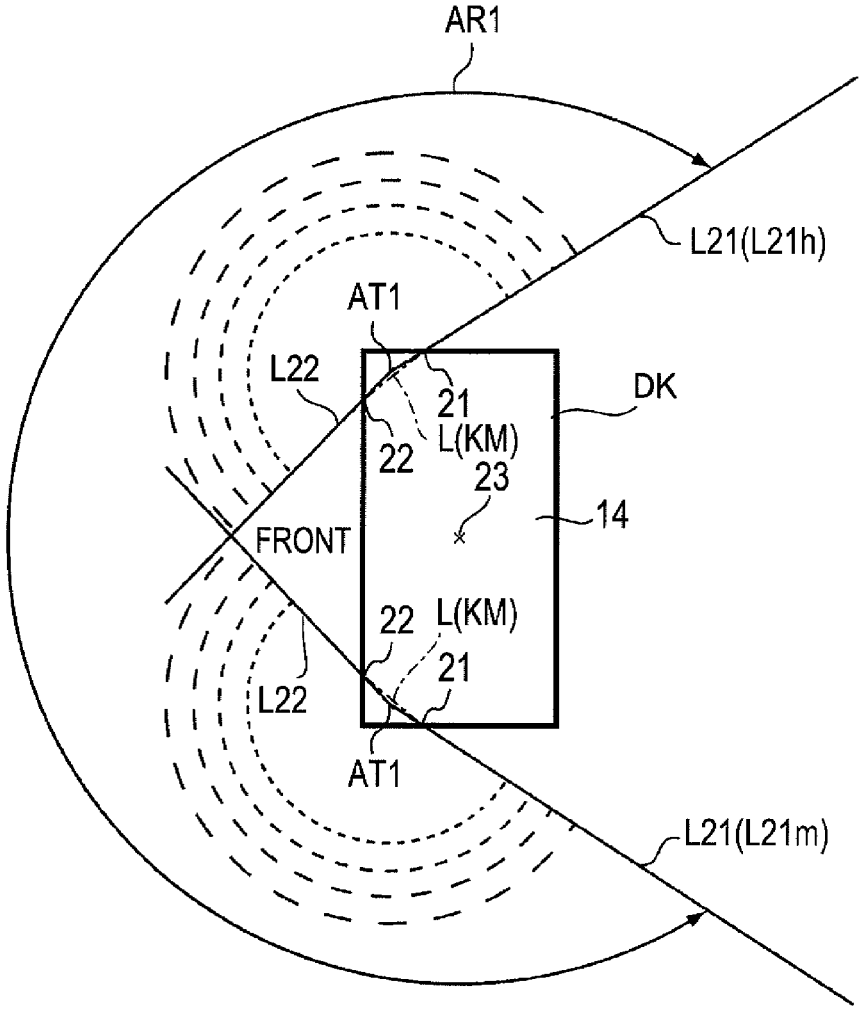
FIG. 6 is a view explaining the position of an antenna element and its antenna sensitivity in the electronic equipment DK shown in FIGS. 1 to 3.

The attachment position of the antenna substrate 6 will be described with reference to FIGS. 1, 2, 6, 7 and 8, in detail. FIG. 6 is a view explaining the position of the antenna element and the antenna sensitivity in the electronic equipment DK shown in FIGS. 1 to 3. FIG. 6 is a view of the electronic equipment DK viewed from the side of its top face. In the figure, the positions of the antenna elements viewed from the side of the top face of the electronic equipment DK are represented by points AT1, the positions of innermost end sides 7 on the rear side of the cutouts 5 of FIGS. 1 and 8 are represented by points 21, and the positions of outermost radio shielding parts in the front face in the right-to-left direction of the electronic equipment DK are represented by points 22.

When the electronic equipment DK includes the door 15, the points 22 correspond to respective positions (viewed from the side of the top face) of left/right end sides situated in the outermost positions in the right-to-left direction of the equipment: the left/right end sides being selected from either the left/right ends 15*ht*, 15*mt* of the metal door 15 of FIG. 2 or the left/right ends 4*ht*, 4*mt* as the left/right end sides of the metal chassis 4*k* of the disc drive units 4 of FIGS. 1 and 4. While, when the electronic equipment DK does not include the door 15, the points 22 correspond to respective positions (viewed from the side of the top face) of the left/right ends 4*ht*, 4*mt* of the front end face of the metal chassis 4*k* of the disc drive units 4.

Figure 7:
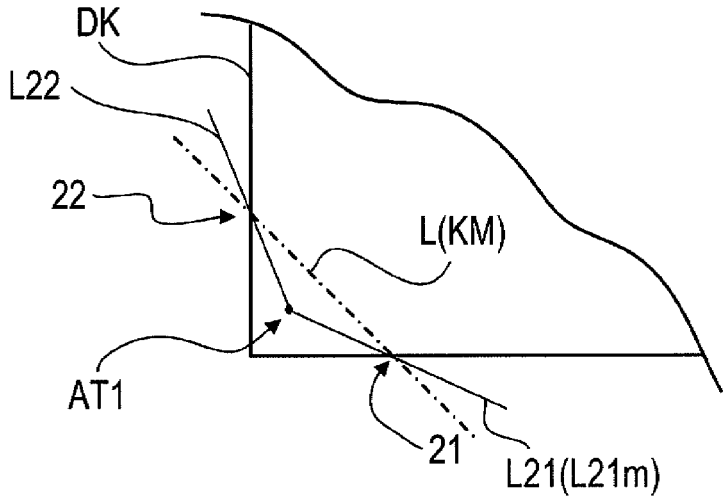
FIG. 7 is an enlarged view of a part of the explanatory view of FIG. 6.
Figure 8:
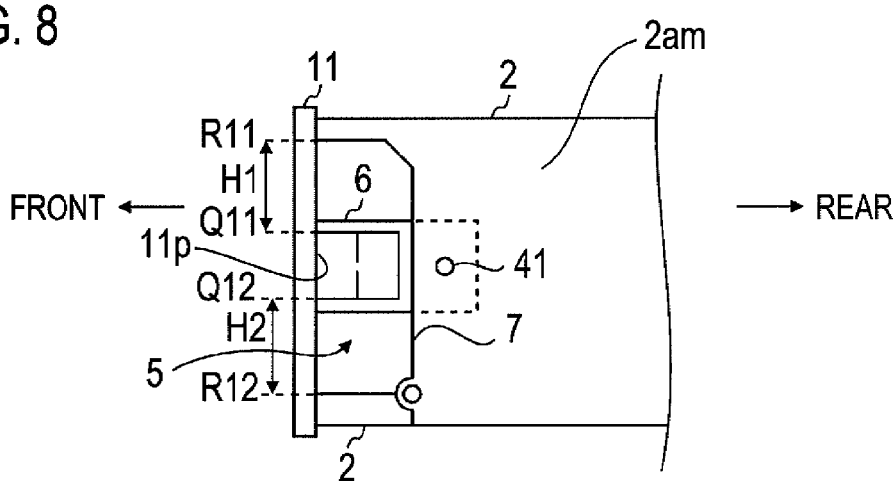
FIG. 8 is a view explaining an example of a structure for attaching the antenna substrate of FIG. 5 to a front panel and the metal casing.

FIG. 7 is an enlarged view of a part of the explanatory view shown in FIG. 6. Under condition of viewing the electronic equipment DK from the side of its top face, the line segment L is virtually-defined as a line connecting the position (point 21) of an innermost back end (end side) 7 in each cutout 5 of the left/right side plates 2*ah*, 2*am* with another position (point 22) of the left (right) end 15*ht* (15*mt*) of the metal door 15 constituting a disturbance member of radio waves. That is, the line segment L is defined on either side of the equipment in the right-to-left direction, in pairs.

The reference plane KM is defined as a vertical plane containing the line segment L and also extending in the top-to-bottom direction. The antenna substrates 6 are respectively fixed to the left side plate 2*ah* and the right side plate 2*am* so that each of the wiring patterns 6*a* as the antenna elements is positioned outside the reference plane KM. In FIGS. 6 and 7, the antenna elements are illustrated by the points AT1 for descriptive purposes. Nevertheless, as the antenna element is formed in a predetermined size actually, it is desirable that the whole antenna element is fixed so as to be located outside the reference plane KM.

The opening 3 of the casing 2 except its area containing the insert slot 4*a* for disc is covered with the nonmetallic front panel 11. The front panel 11 is provided, in its area containing the insert slot 4*a*, with the opening 11*a*.

Including the cutouts 5 and the antenna substrates 6, at least the left side face, the right side face and the top face of the casing 2 are covered with the nonmetallic decorative side plates 13, 12 and the top plate 14, respectively. Assume that in FIG. 3 the cutout 5 and the antenna substrate 6 in the right side face constitute an antenna part 16. Then, the antenna part 16 is covered with the decorative plate 12. In FIG. 3, the antenna part 16 is shown with a broken line.

As shown in FIG. 1, the door 15 is arranged so as to cover at least the opening 11*a* and the insert slot 4*a* of the disc drive unit 4 at the normal position. The door 15 may be provided so as to cover part or all of an operating panel (not shown) for manipulating the electronic equipment DK at the normal position and also expose the same panel partially or wholly, at the disc insertion/withdrawal position. The door 15 is positioned ahead of the end sides 7 of the cutouts 5.

[Antenna Sensitivity]

In the electronic equipment DK, the antenna element is arranged outside the reference plane KM. In FIGS. 6 and 7, a line segment L21 is part of a virtual line having a base point of the point AT1 and passing through the point 21 when viewed from a top face of the electronic equipment DK. A line segment L22 is part of a line having a base point of the point AT1 and passing through the point 22. When viewed from the top face's side of the electronic equipment DK, it has good antenna sensitivity on both the exterior side of the line segment L21 and the exterior side of the line segment L22. Consequently, as shown in FIG. 6, the electronic equipment DK has antenna sensitivity which is particularly favorable in an angular range AR1 corresponding to a major angle defined by the left line segment L21*h* and the right line segment L21*m*, owing to the left and right wiring patterns 6*a* in pairs as the antenna element.

Therefore, the electronic equipment DK is capable of receiving radio waves entering through the wide angular range expanding from the front side of the equipment backward, excellently. Also, the electronic equipment DK is capable of transmitting radio waves to the wide angular range expanding from the front side of the equipment backward, excellently. In addition, even when accommodating an electronic block, such as the disc drive unit 4, which includes a metallic chassis having restrictions in arranging the block inside the casing 2, the electronic equipment DK can minimize a reduction of the radio shielding effect by the casing 2 and the electronic block, allowing antenna's forward and lateral sensitivity to be ensured favorably.

The radio unit 1 selects favorable one of the pair of antenna elements (wiring patterns 6*a*) due to diversity, preferentially.

The cutout 5 is formed to have dimensions such that the casing 2 does not cover (overlap) the wiring pattern 6*a* in the antenna substrate 6. Preferably, the length of the cutout 5 in the direction of depth is more than $\lambda/4$, while its length in the top-to-bottom direction is more than $\lambda/6$. It is desirable that the cutout 5 is formed as small as possible, in order to ensure the strength of the casing 2 and shield unnecessary radiation out of the electronic block 4 accommodated in the casing 2. For instance, the cut out 5 may be formed with a length of $\lambda/4$ in the direction of depth. The length of the cutout 5 in the direction of depth is not limited to $\lambda/6$ only and thus includes an allowable error range. The allowable error range can be introduced from actual measurements obtained by measuring the receiving situation of radio waves.

The antenna element shown in FIG. 5 does not have high directional characteristics in a specific direction but directionality covering a wider area.

In the electronic equipment DK, the antenna sensitivity in the top-to-bottom direction is ensured by the cutout 8 forming the top plate 2*at* of the upper casing 2*a*. In the vicinity of the opening 11*a* and the right side plate 2*am*, the cutout 8 is formed with one length more than $\lambda/4$ in the right-to-left direction and another length more than $\lambda/4$ in the direction of depth. The top plate 2*at* of the upper casing 2 is provided, near the opening 11*a* and left side plate 2*ah*, with a similar cutout to the cutout 8.

[Attaching of Antenna Substrate]

FIG. 8 is a view explaining one example of a structure for attaching the antenna substrate 6 of FIG. 5 to the front panel 11 and the casing 2.

In this example, the front panel 11 is provided, at a center part of its short side, with a salient 11*p* into which a notch 6*b* (see FIG. 5) of the antenna substrate 6 is engaged. The antenna substrate 6 is fixed to the casing 2 by assembling the casing 2 (the upper casing 2*a* and the lower casing 2*b*) under condition that the salient 11*p* is engaged into the notch 6*b*. The antenna substrate 6 is arranged so as to adhere tightly to the inside face of the casing 2. Nevertheless, at least the wiring pattern 6*a* of the antenna substrate 6 is exposed in a position corresponding to the cutout 5. Under a condition that the reference plane KM intersects with the antenna substrate 6, for instance, it is desirable that the antenna substrate 6 is fixed to the casing so as to locate the wiring pattern 6*a* outside the reference plane KM and also locate its intersection with the reference plane KM behind the virtual line segment P1 of FIG. 5 (right on paper of FIG. 5).

As for the positioning of the wiring pattern 6*a* in the top-to-bottom direction, the wiring pattern 6*a* is arranged so as to put its upper end (at a position Q11 of FIG. 8) and the lower end (at a position Q12 of FIG. 8) apart from the upper end (at a position R11 of FIG. 8) of the cutout 5 and the lower end (at a position R12 of FIG. 8), respectively. It is desirable that the wiring pattern 6*a* is arranged so that a distance H1 of FIG. 8 between the upper end of the pattern 6*a* and the upper end of the cutout 5 and a distance H2 between the lower end of the pattern 6*a* and the lower end of the cutout 5 become the largest ones, respectively.

The fixing of the antenna substrate 6 to the casing 2 is attained by inserting a male screw 41 into a hole (not shown) of the right side plate 2*am* of the casing 2 and a hole 36 of the antenna substrate 6 and successively screw-engaging the male screw 41 with a not shown nut.

Figure 9:
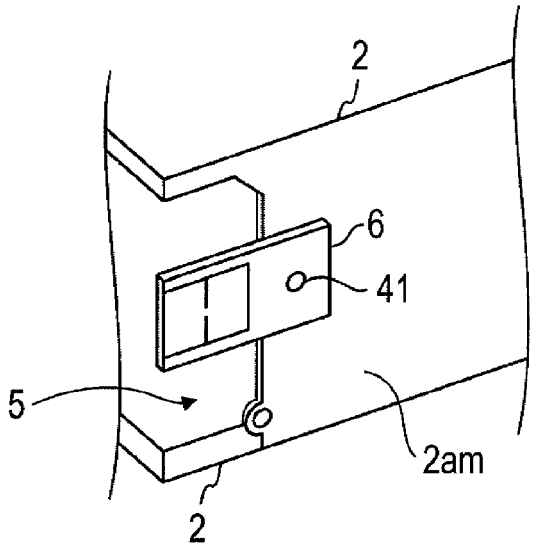
FIG. 9 is a view explaining another structure for attaching the antenna substrate of FIG. 5 to the metal casing.
Figure 10:
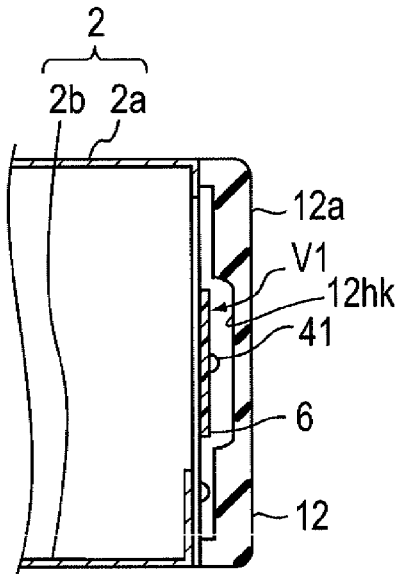
FIG. 10 is a view showing a structural example of a side plate in the attachment structure of FIG. 9.
Figure 11:
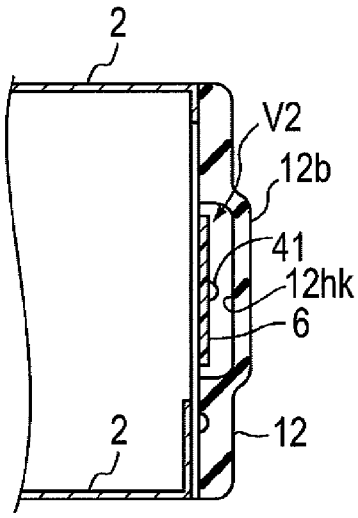
FIG. 11 is a view showing another structural example of a side plate in the attachment structure of FIG. 9.

FIGS. 9 to 11 are views explaining another structure for attaching the antenna substrate 6 shown in FIG. 5 to the casing 2. FIG. 9 shows an attachment structure with which the antenna substrate 6 is attached to the casing 2. FIG. 10 is a view showing a structural example of the decorative side plate 12 when using the attachment structure of FIG. 9. FIG. 11 is a view showing another structural example of the decorative side plate 12 when using the attachment structure of FIG. 9.

In the example shown in FIG. 9, the antenna substrate 6 is attached to an outside surface of the right side plate 2*am* of the casing 2 by the male screw 41. In this case, the hole 36 is formed so as to be a through-hole through which the male screw 41 is inserted. Meanwhile, a female screw is formed in the casing 2.

The antenna substrate 6 is arranged outside the casing 2. In this structural example, the decorative side plates 12, 13 are provided with recesses 12*hk* for accommodating the antenna substrates 6, respectively. FIGS. 10 and 11 illustrate the structural example of the decorative side plate 12. The decorative side plate 13 is similar in structure. Between the inner face of the decorative side plate 12 and the right side plate 2*am*, a space is defined by the recess 12*hk*.

In the example shown in FIG. 10, an outside surface 12*a* of the decorative side plate 12 is flat. The decorative side plate 12 is provided, on the side of its inner surface, with a space V1 accommodating the antenna substrate 6. In the example shown in FIG. 11, corresponding to a space V2 accommodating the antenna substrate 6, there is a bulge 12*b* projecting outside the decorative side plate 12.

Figure 12:
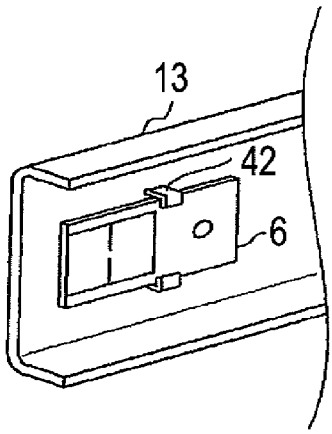
FIG. 12 is a view showing yet another attachment structure of the antenna substrate of FIG. 5.

FIG. 12 is a view showing yet another attachment structure of the antenna substrate 6 shown in FIG. 5. In this structure, the antenna substrates 6 are attached to not the casing 2 but the decorative side plates 12, 13 as nonmetallic members for covering the cutouts 5. FIG. 12 illustrates the decorative side plate 13. The decorative side plate 12 is similar in structure. The side plates 12, 13 are provided with hooks 42 for engaging the antenna substrates 6.

Figure 13:
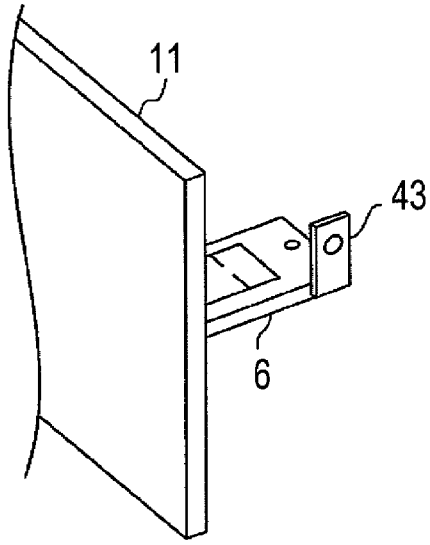
FIG. 13 is a view showing still another attachment structure of the antenna substrate of FIG. 5.

FIG. 13 is a view showing a further different attachment structure of the antenna substrate 6 shown in FIG. 5. In this structure, the antenna substrate 6 is attached so that its substrate face intersects with the surface of the right side plate 2*am* with the cutout 5 of the casing 2 at a right angle. In other words, the antenna substrate 6 is arranged so that the substrate face becomes parallel to the surface of the top plate 14. As a concrete example, the antenna substrate 6 is attached to an attachment 43 projecting from the inner face of the front panel 11.

For instance, when two antenna substrates 6 are arranged on both sides of the opening 2 in the casing 2 as shown in FIG. 1, either one of the substrates may be attached in accordance with the structure shown in FIG. 13. In this case, as respective substrate faces of two antenna substrates 6 intersect with each other at a right angle, it is possible to attain favorable reception irrespective of polarization directions of incoming radio waves. Alternatively, as the radio waves whose polarization directions intersects with each other at a right angle are transmitted, a recipient can receive the radio waves irrespective of the polarization direction of an antenna on the receiver's side properly.

In the above description, the antenna substrates 6 are supposed to be arranged on both sides of the opening 3 of the casing 2 in the right-to-left direction. However, the antenna substrate 6 may be arranged on one side of the opening 3 in the right-to-left direction. In addition, although the disc drive unit 4 or the door 15 is illustrated as a radio disturbance member, another member may be used instead so long as the radio disturbance member is arranged in the opening 3 of the casing 2.

In the electronic equipment 4 having the built-in disc drive unit 4 for driving a disc inserted from the outside, as mentioned above, it is required to locate the disc drive unit 4 forward in the casing 2, as much as possible. According to the embodiment, even when there is such a restriction in arranging the equipment in the casing 2, it is possible to hold a reduction in the shielding effect of electromagnetic waves by the casing to a minimum and also possible to ensure the sensitivity of an antenna in the extremely-wide angular range expanding from the front of the equipment backward.

Again, although the radio unit 1 is disposed in the casing 2 in the above-mentioned structure, the position is not limited to only the illustrated arrangement, and therefore the radio unit may be arranged outside the casing 2 alternatively. In addition, the wiring pattern 6*a* of the antenna substrate 6 may be formed by any antenna element besides the fork hentenna.

[Modification]

Instead of fixing the antenna substrates 6 to the left and right side plates 2*am*, 2*ah* directly, alternatively, the former may be fixed to the latter through substrate holders.

Figure 14:
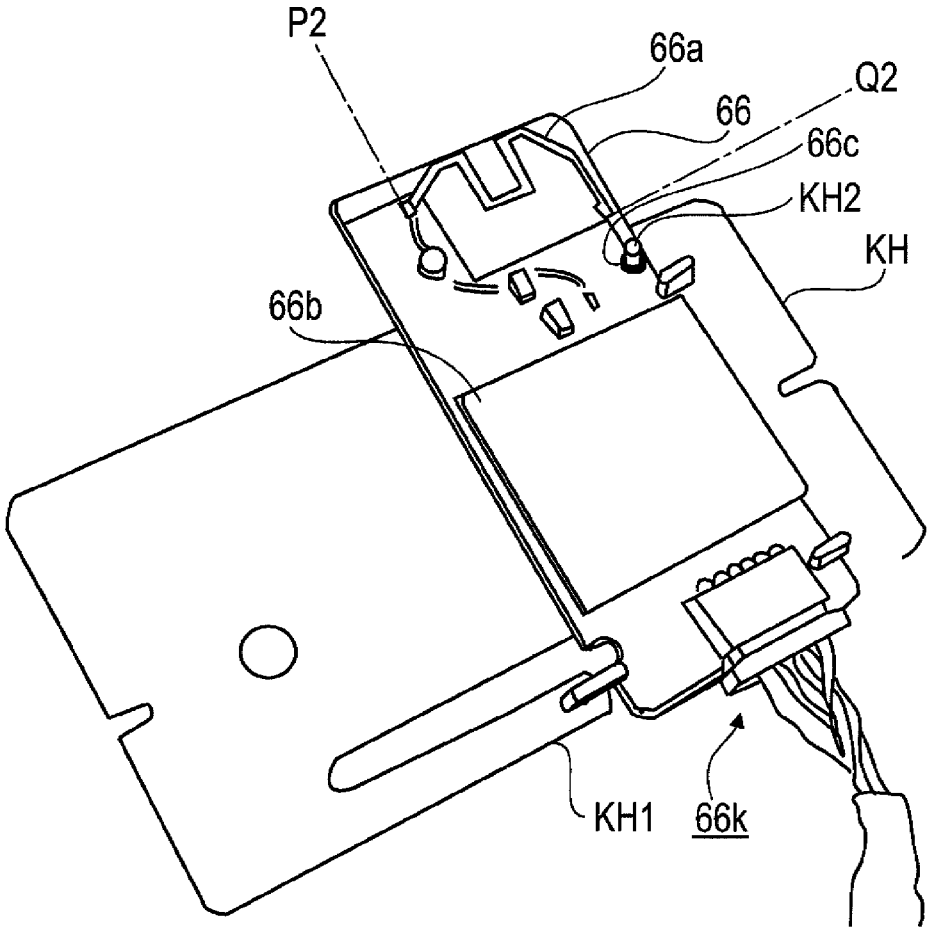
FIG. 14 is a view explaining the antenna substrate before deformation and a substrate holder retaining the antenna substrate.
Figure 15:
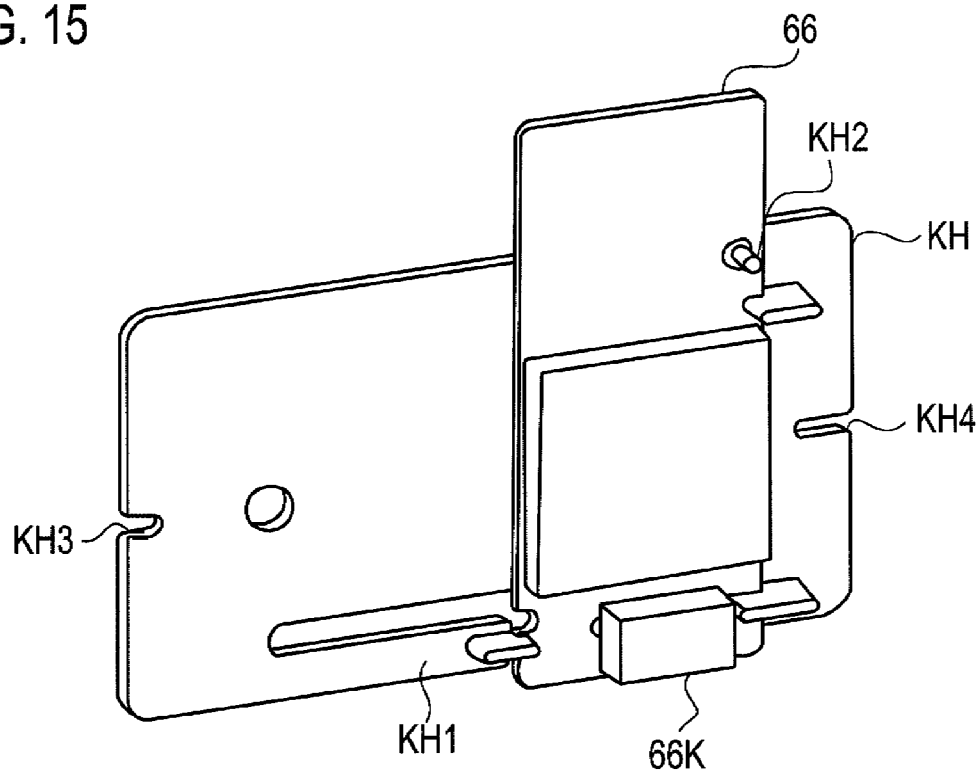
FIG. 15 is a typical view explaining the antenna substrate of FIG. 12 and a substrate holder retaining the antenna substrate.

FIGS. 14 and 15 show an antenna substrate 66 and a substrate holder KH holding the antenna substrate 66 both used in a modification of the antenna arrangement structure of the above-mentioned embodiment. FIG. 15 is a typical figure.

The antenna substrate 66 is formed so as to be a generally-rectangular plate and comprises a wiring pattern 66*a* printed as an antenna element, a communication module part 66*b* allowing a communication through wireless LAN and a connector part 66*k* for giving and receiving signals between the antenna substrate 66 and its outside. The wiring pattern 66*a* is arranged close to one leading end of the print substrate 66 in the longitudinal direction.

The substrate holder KH is formed with outside dimensions generally-equal to those of the antenna substrate 6. The substrate holder KH is made of resin and holds the antenna substrate 66 by means of not screws but an elastic holder arm KH1 and a boss KH2 for engagement with a hole 66*c* formed in the antenna substrate 66. The substrate holder KH holds the antenna substrate 66 so that the wiring pattern 66*a* of the antenna substrate 66 is exposed without overlapping the substrate holder KH. The substrate holder KH is formed into a sheet whose longitudinal direction coincides with a right-to-left direction of FIG. 15. The substrate holder KH holds the antenna substrate 66 so that the longitudinal direction of the antenna substrate 66 intersects with the longitudinal direction of the substrate holder KH at a right angle. The substrate holder KH has slits KH3, KH4 formed at respective centers of both short sides of the holder.

The wiring pattern 66*a* as the antenna element is formed with a length attuned to a wavelength of wireless LAN, providing a monopole antenna having a length, for example, λ/4.

Figure 16:
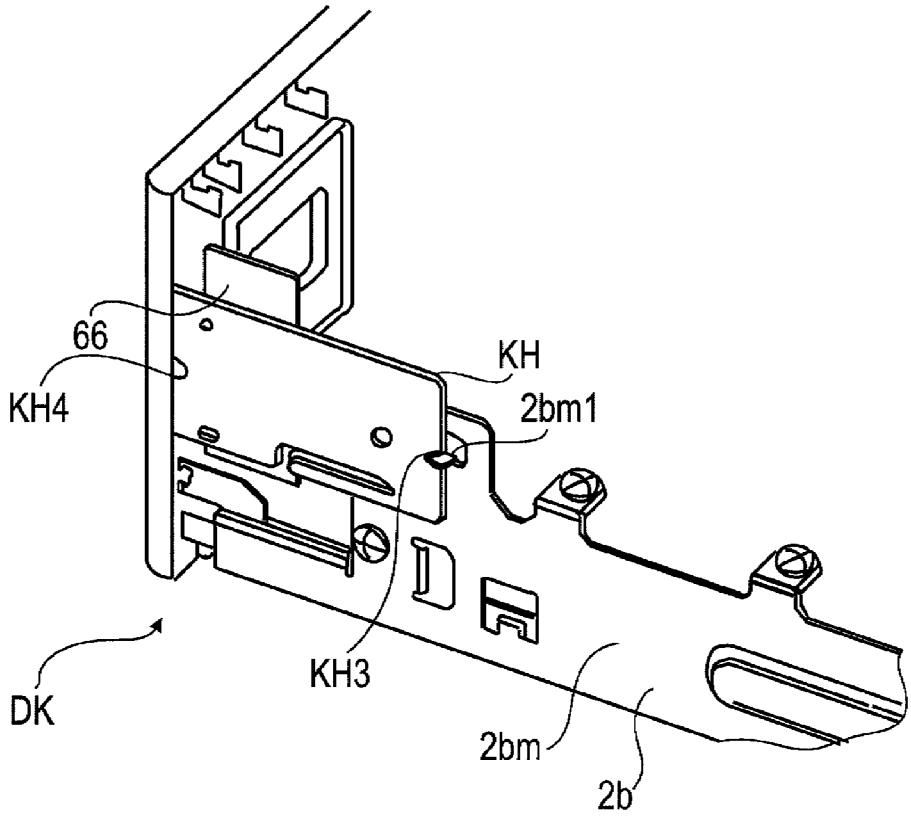
FIG. 16 is a perspective view showing a condition where a decorative side plate, a top plate and an upper casing before deformation are detached.

FIG. 16 is a perspective view showing a right frontal portion of the electronic equipment DK mounting the antenna arrangement structure in the modification with all of the decorative side plate 12, the top plate 14 and the upper casing 2*a* detached from the equipment. FIG. 16 illustrates a state that a male screw for fixing the antenna substrate 66 is also detached from the equipment. The substrate holder KH is arranged in position since the slits KH3, KH4 engage with a lug part 2*bm*1 formed in the right flange 2*bm* of the lower casing 2*b* and a not-shown projection of the front panel 11, respectively.

Figure 17:
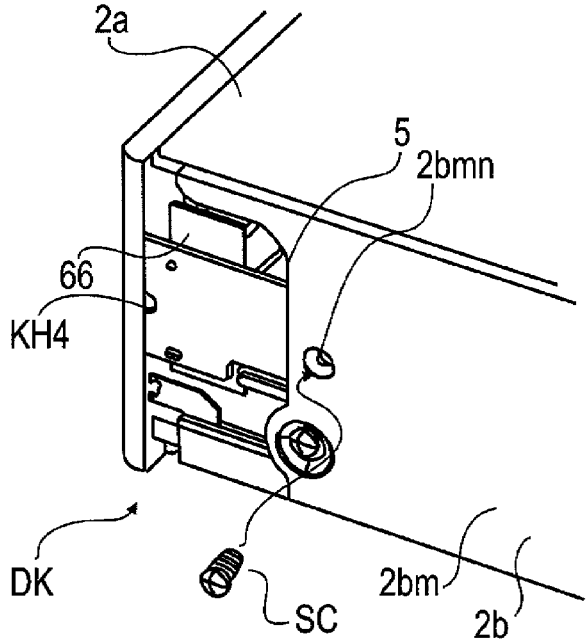
FIG. 17 is a view showing a condition where the upper casing is attached in contrast to the condition of FIG. 16.

FIG. 17 illustrates a state that an upper casing 2*a* is attached to the arrangement of FIG. 16. As shown in FIG. 17, the fixing of the substrate holder KH is attained since a male screw SC is screw-engaged into a female screw 2*bmn* provided in the lower casing 2*b* so as to interpose the upper casing 2*a* and the substrate holder KH. In the upper case 2*am*, the cutout 5 is formed on the front side of the right side plate 2*a*. Also in this modification, the antenna substrate 66 is attached so that the wiring pattern 66*a* is positioned outside the reference plane KM, as similar to the above-mentioned embodiment.

In the arrangement where the reference plane KM intersects with the antenna substrate 66, for instance, it is preferably fixed so that the wiring pattern 66*a* is positioned outside the reference plane KM and the intersecting point with the reference plane KM is behind a virtual line segment P2 shown in FIG. 14 (i.e. the left hand of the plane of FIG. 14).

In FIGS. 16 and 17, the antenna substrate 66 is retained so that the wiring pattern 66*a* becomes exposed upward of the substrate holder KH. In detail, as shown in FIG. 14, the antenna substrate is retained so that the wiring pattern 66*s* is positioned outside the substrate holder KH with no overlapping of the substrate holder KH. Consequently, the position of the wiring pattern 66*a* in the top-to-bottom direction gets higher than the center of the electronic equipment DK in the top-to-bottom direction.

Generally, as "in-room" type audio-video equipments are apt to be arranged on the lower side of a room, such a positioning of the wiring pattern 66*a* in the upper side of the electronic equipment DK in the top-to-bottom direction allows favorable sensitivity to effected on the top side in comparison to the bottom side, improving "in-door" transmission/reception circumstances about the equipment. Thus, even if the electronic equipment DK is provided with the door 15, the antenna sensitivity in the top-to-bottom direction becomes insusceptible to the door 15 owing to the above positioning. In this view, it is desirable that the vertical position of the wiring pattern 66*a* is located on the upper side in the electronic equipment DK.

Figure 18:
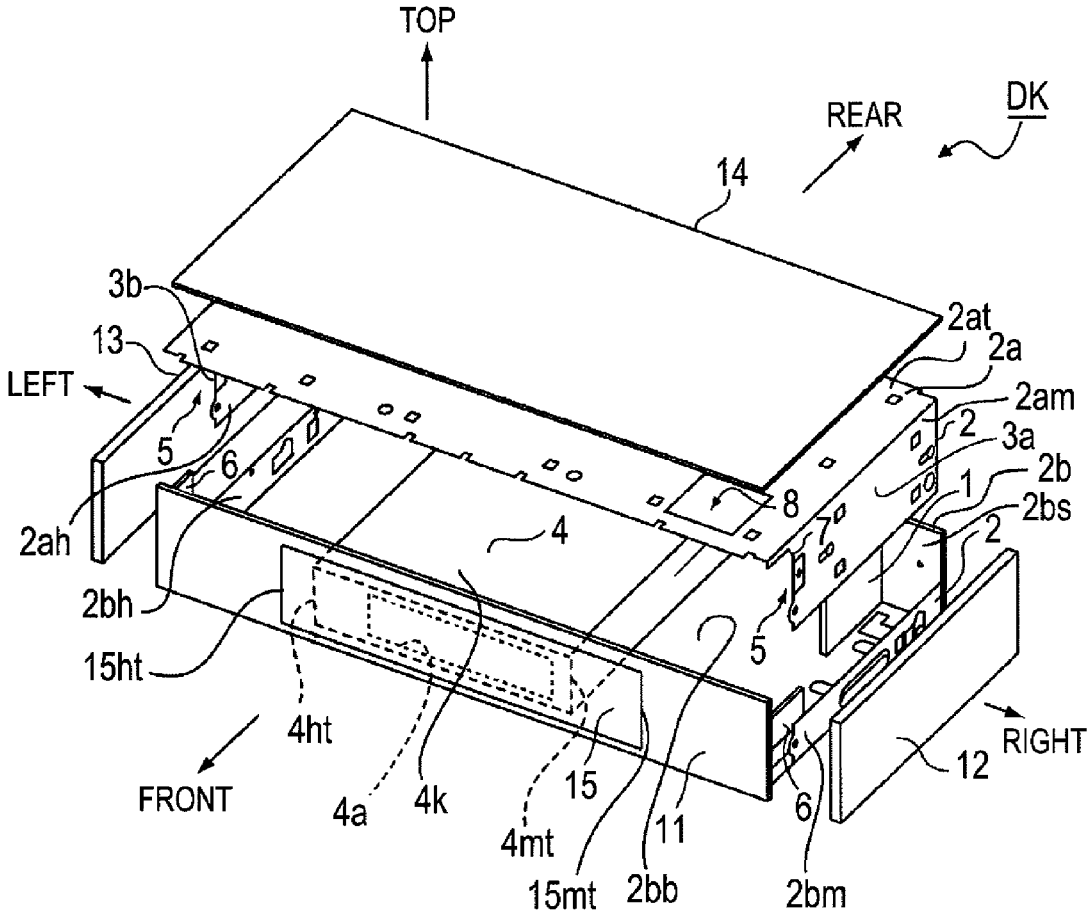
FIG. 18 is a view explaining the arrangement where a disc drive unit 4 is built in the electronic equipment DK of the embodiment.

FIG. 18 is a view explaining the arrangement of the disc drive unit 4 in the electronic equipment DK. In the chassis 4K of the disc drive unit 4, the front end face 4*zt* (see FIG. 4) is located in contact with or adjacent to the front panel 11. In the front end face 4*zt* of the chassis 4K of the disc drive unit 4, additionally, its left end side 4*ht* and right end side 4*mt* are also located in contact with or adjacent to the front panel 11.

Figure 19:
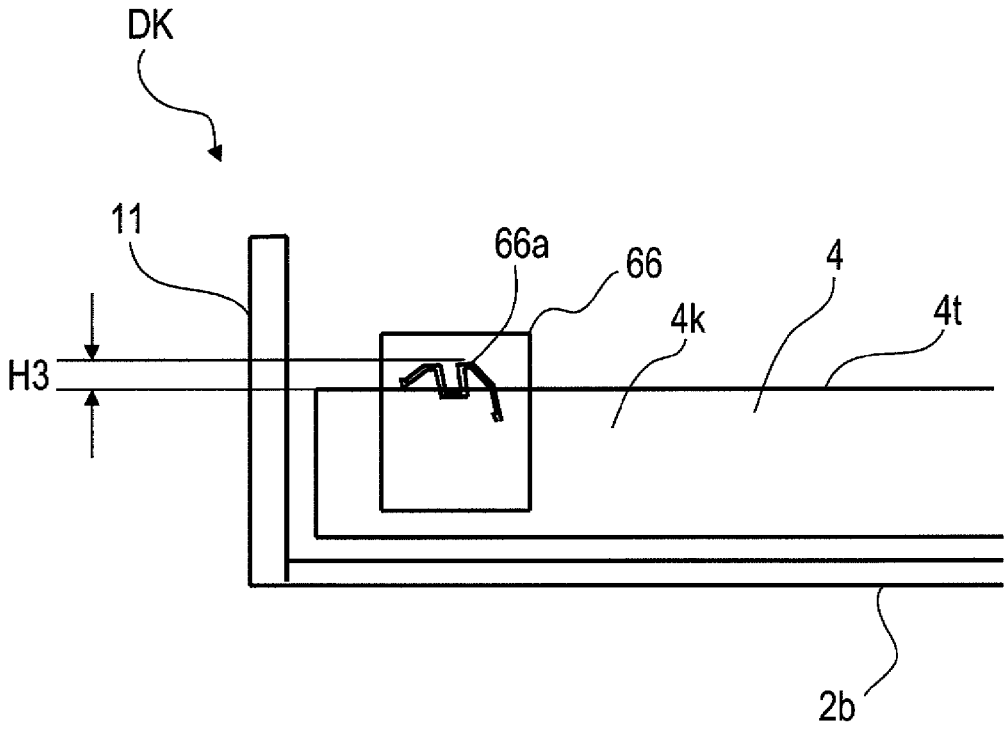
FIG. 19 is an explanatory view showing the positional relationship between a wiring pattern 66*a* and a metal door 15 in the top-to-bottom direction in the arrangement where the electronic equipment DK in a modification includes the metal door 15.

In the electronic equipment DK provided with the disc drive unit 4, FIG. 19 is an explanatory view showing the positional relationship between the wiring pattern 66*a* and the disc drive unit 4 in the top-to-bottom direction. In FIG. 19, the wiring pattern 66*a* is partially positioned above the top plate 4*t* of the disc drive unit 4. Concretely, the uppermost end of the wiring pattern 66*a* is located above the top plate 4*t* of the chassis 4*k* of the disc drive unit 4 by a distance H3. With the arrangement of FIG. 19, it is possible to maintain the antenna sensitivity favorable in the right-to-left direction (i.e. direction perpendicular to the plane of FIG. 19). It is desirable to establish the distance H3 as large as possible.

Figure 20:
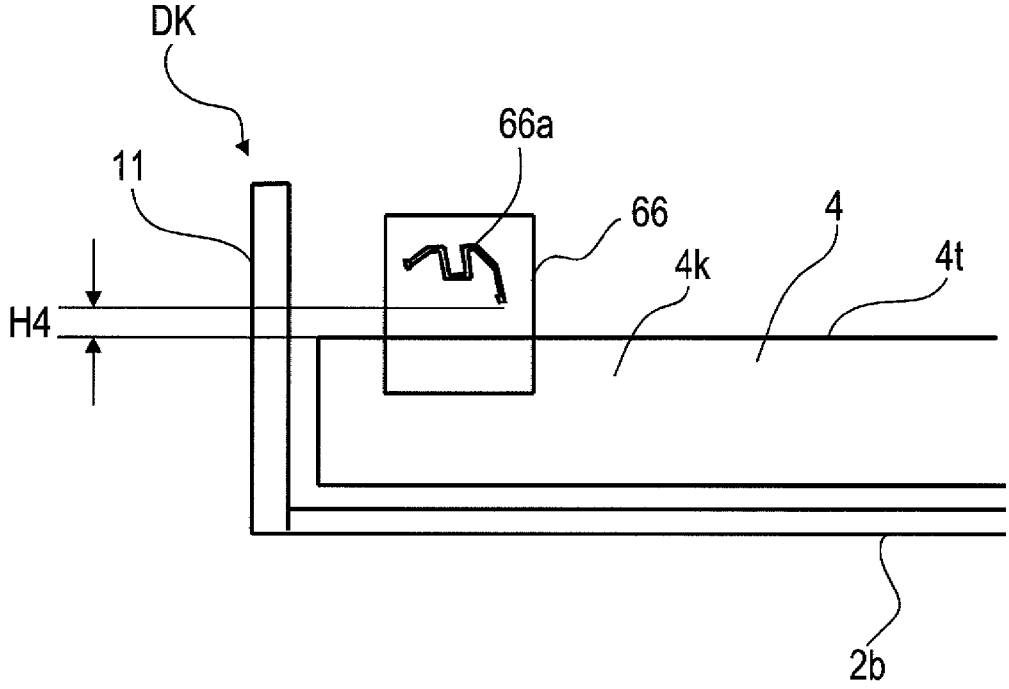
FIG. 20 is an explanatory view showing the preferable positional relationship between the wiring pattern 66*a* and the disc drive unit 4 in the top-to-bottom direction in the arrangement where the electronic equipment DK in a modification includes the disc drive unit 4.

In the electronic equipment DK provided with the disc drive unit 4, FIG. 20 is an explanatory view showing a better positional relationship between the wiring pattern 66*a* and the disc drive unit 4 in the top-to-bottom direction. In FIG. 20, the lowermost end of the wiring pattern 66*a* (e.g. the position of a virtual line segment Q2 of FIG. 14) is located above the top plate 4*t* of the chassis 4*k* of the disc drive unit 4 by a distance H4. With the arrangement of FIG. 20, it is possible to maintain the antenna sensitivity favorable in the right-to-left direction (i.e. direction perpendicular to the plane of FIG. 20). It is desirable to establish the distance H4 as large as possible.

Figure 21:
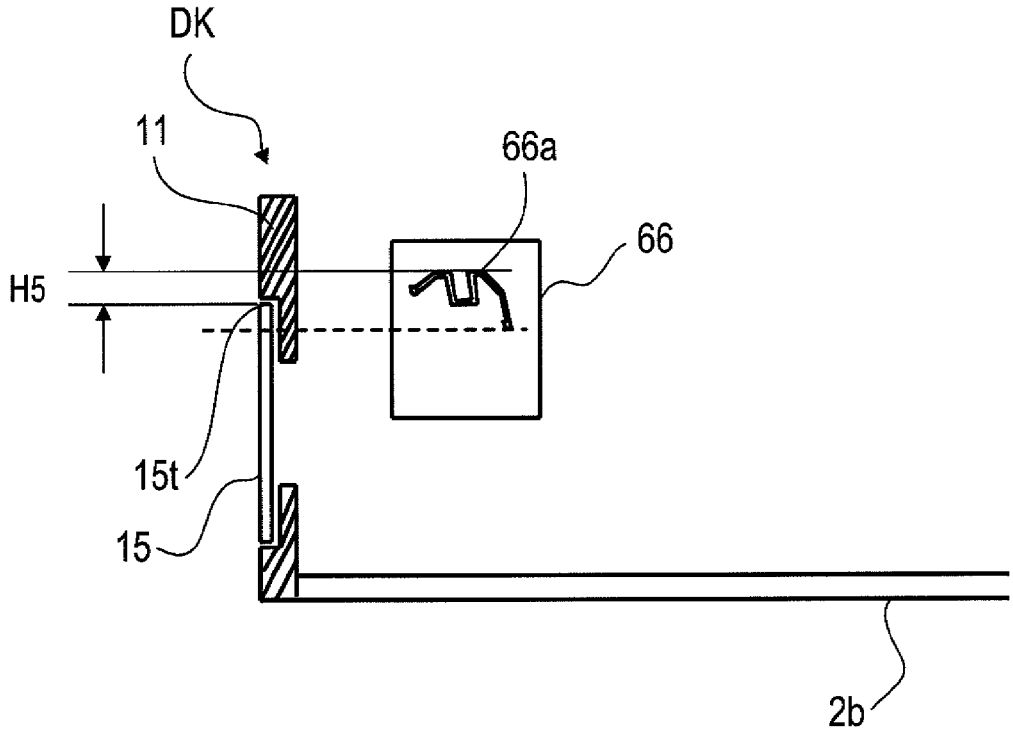
FIG. 21 is an explanatory view showing the positional relationship between the wiring pattern 66*a* and the metal door 15 in the top-to-bottom direction in the arrangement where the electronic equipment DK in a modification includes the metal door 15.

In the electronic equipment DK provided with the metal door 15, FIG. 21 is an explanatory view showing the positional relationship between the wiring pattern 66*a* and the door 15 in the top-to-bottom direction. In FIG. 21, the wiring pattern 66*a* is partially positioned above the upper end 15*t* of the door 15. Concretely, the uppermost end of the wiring pattern 66*a* is located above the top end 15*t* of the door 15 by a distance H5. With the arrangement of FIG. 21, it is possible to maintain the antenna sensitivity favorable irrespective of the present of the door 15. It is desirable to establish the distance H5 as large as possible.

Figure 22:
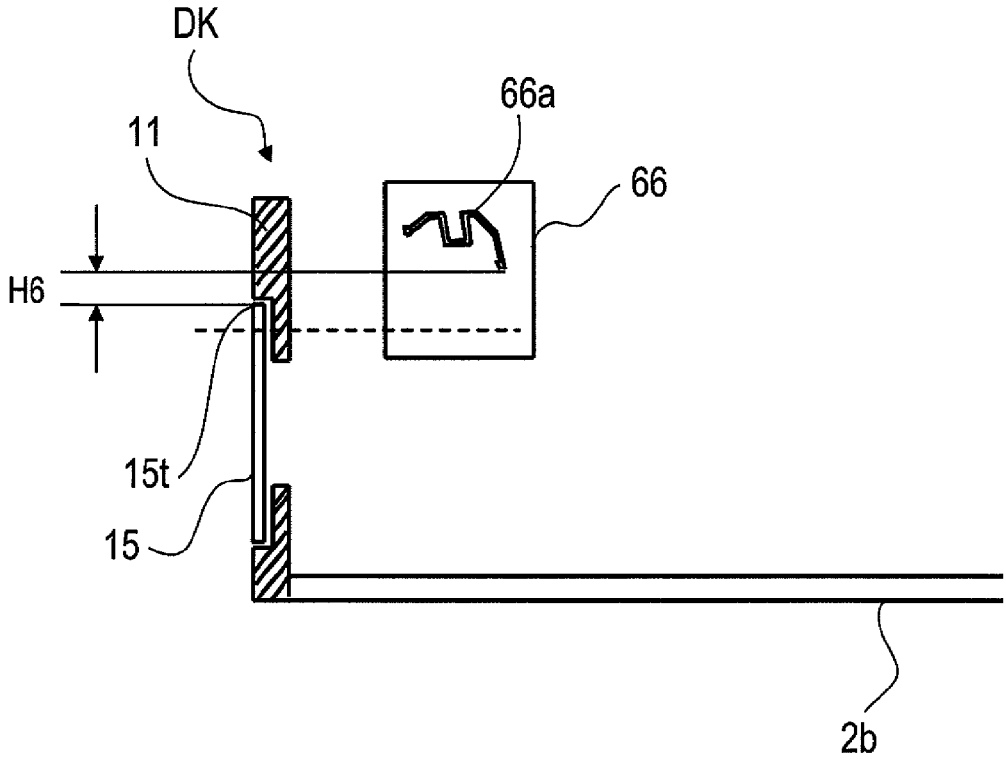
FIG. 22 is an explanatory view showing a better positional relationship between the wiring pattern 66*a* and the metal door 15 in the top-to-bottom direction in the arrangement where the electronic equipment DK in a modification includes the metal door 15.

In the electronic equipment DK provided with the door 15, FIG. 22 is an explanatory view showing a better positional relationship between the wiring pattern 66*a* and the door 15 in the top-to-bottom direction. In FIG. 22, the lowermost end of the wiring pattern 66*a* is located above the top end 15*t* of the door 15 by a distance H6. With the arrangement of FIG. 22, it is possible to maintain the antenna sensitivity favorable in the right-to-left direction (i.e. direction perpendicular to the plane of FIG. 22). It is desirable to establish the distance H6 as large as possible.

When the electronic equipment DK is equipped with both of the disc drive unit 4 and the door 15, it is desirable to arrange the wiring pattern above the top end of a higher one of the two. In addition, if the arrangement of the disc drive unit 4 or the door 15 is biased upwardly, the wiring pattern 66*a* may be arranged blow either lower end of the disc drive unit 4 and the door 15.

Although the embodiment and the modification have been illustrated with the example of forming the antenna element in the antenna substrate 66 by the wiring pattern 66*a*, a chip antenna may be adopted as the antenna element without being limited to the wiring pattern only. Then, preferably, the chip antenna in place of the wiring pattern 66*a* is arranged above the top end of the disc drive unit 4 or the door 15. Note that the illustrated equipment in the embodiment or its modification is also favorable in appearance since the antenna is covered with the front panel 11, the decorative plates 12, 13 and the top plate 14.

In common with the embodiment and the modification, the radio unit has been illustrated as an element performing both of transmission and reception of radio waves. However, the radio unit may be constructed so as to perform either one of transmission and reception. In addition, although the antenna substrates in pairs are arranged left and right in common with the embodiment and the modification, a single antenna may be arranged on one side. Still further, the equipment may be provided with two or more pairs of antenna substrates.

In the above description, the terminologies of "front", "rear", "left", "right", "top" and "bottom" have been used to indicate respective directions. However, it should be noted that these terms do not indicate specific directions in an actually-implemented equipment but are used for purposes of illustration simply.

INDUSTRIAL APPLICABILITY

The present invention is available for any electronic equipment.

DESCRIPTION SIGNS LIST

1 . . . Radio Unit
2 . . . Casing
2*a* . . . Upper Casing
2*at* . . . Top Plate
2*am* . . . Right Side Plate
2*ah* . . . Left Side Plate
2*b* . . . Lower Casing
2*bb* . . . Bottom Plate
2*bm* . . . Right Flange
2*bm*1 . . . Lug Part
2*bmn* . . . Female Screw
2*bh* . . . Left Flange
2*bs* . . . Back Plate
3 . . . Opening
4 . . . Disc Drive Unit
4*a* . . . Insert Slot
4*ht* . . . Left End
4*k* . . . chassis
4*mt* . . . Right End
4*t* . . . Top Plate
4*zt* . . . End Face
5 . . . Cutout
6, 66 . . . Antenna Substrate
6*a*, 66*a* . . . Wiring Pattern
7 . . . Margin Side
11 . . . Front Panel
11*a* . . . Opening
11*p* . . . Salient
12, 13 . . . Decorative plate
12*b* . . . Bulge
12*hk* . . . Recess
14 . . . Top Plate
15 . . . Door
15*ht* . . . Left End
15*mt* . . . Right End
15*t* . . . Top End
16 . . . Antenna Part
23 . . . Center (of Casing 2)
31, 32 . . . Parallel Line
33 . . . End Line
34 . . . Power Supply Line
35 . . . Connecting Terminal
36 . . . Hole
41, SC . . . Male Screw
42 . . . Hook
43 . . . Attachment
66*b* . . . Communication Module Unit
66*c* . . . Hole
66*k* . . . Connector Part
KH . . . Substrate Holder
KH1 . . . Holder Arm
KM . . . Reference Plane
DK . . . Electronic Equipment
V1, V2 . . . Space

The invention claimed is:

1. An electronic equipment comprising:
an antenna configured to transmit or receive radio waves;
a metal casing defining a first face, a second face connected the first face and a third face connected to the first face and the second face, the first face being formed so as to provide an opening; and
a shielding member arranged adjacent to the first face to shield the radio waves, wherein
the metal casing has a cutout formed in the second face so as to come close to the first face,
at least part of the shielding member is arranged on the side of the first face to a first end of the cutout, the first end is further away from the first face than a second end of the cutout on the side of the first face; and wherein
in a view perpendicular to the third face, the antenna is positioned on one side of a virtual line connecting a corner of the shielding member adjacent to the first face and closest to the second face with the first end of the cut out, the one side excluding a center of the metal casing.

2. The electronic equipment of claim 1, wherein
the antenna is in the form of a wiring pattern printed on a substrate, and
the substrate is attached to the metal casing so that the wiring pattern is exposed into the cutout.

3. The electronic equipment of claim 1, wherein the antenna is arranged in each of the second face of the metal casing and a fourth face opposed to the second face.

4. The electronic equipment of claim 2, assuming that a wavelength of center frequency of radio waves transmitted or received by the antenna is represented by $\lambda$, wherein the wiring pattern comprises: parallel lines each having a length of $\lambda/4$ in the direction of depth and being apart from each other at an interval of $\lambda/6$; an end line connecting respective back ends of the parallel lines in the direction of depth with each other; and a power supply line supplying the parallel lines with electric power.

5. The electronic equipment of claim 2, wherein the antenna is arranged in each of the second face of the metal casing and a fourth face opposed to the second face.

6. The electronic equipment of claim 4, wherein the antenna is arranged in each of the second face of the metal casing and a fourth face opposed to the second face.

* * * * *